United States Patent [19]

Normand et al.

[11] Patent Number: 4,822,050

[45] Date of Patent: Apr. 18, 1989

[54] DEVICE FOR READING AND DISTRIBUTING CARDS, IN PARTICULAR PLAYING CARDS

[75] Inventors: Gérard Normand, Besancon; Michel Persuy, Le Vesinet, both of France

[73] Assignee: Acticiel S.A., France

[21] Appl. No.: 23,078

[22] Filed: Mar. 6, 1987

[30] Foreign Application Priority Data

Mar. 6, 1986 [FR] France ..... 86 03161

[51] Int. Cl.[4] ..... A63F 1/14

[52] U.S. Cl. ..... 273/149 P

[58] Field of Search ..... 273/149 R, 149 P

[56] References Cited

U.S. PATENT DOCUMENTS

| | | | |
|---|---|---|---|
| 2,051,615 | 8/1936 | Miles | 273/149 P |
| 2,950,005 | 8/1960 | MacDonald | 273/149 P |
| 3,716,238 | 2/1973 | Porter | 273/149 P |
| 3,768,813 | 10/1973 | Reynolds | 273/149 P |

FOREIGN PATENT DOCUMENTS

| | | | |
|---|---|---|---|
| 907322 | 3/1946 | France | 273/149 P |
| 1429348 | 1/1966 | France | 273/149 P |
| 2540737 | 8/1984 | France | 273/149 P |
| 2576518 | 8/1986 | France | 273/149 P |

*Primary Examiner*—Carlton R. Croyle
*Assistant Examiner*—Eugene L. Szczecina, Jr.
*Attorney, Agent, or Firm*—William A. Drucker

[57] ABSTRACT

The device comprises a container for receiving the pack of cards to be distributed, of which the movable bottom is formed by a carriage. This carriage comprises rollers which, when the carriage is moved, drive the lower card of the pack which is isolated by a flange. The pattern of the transported card is read and this information controls the movement of the carriage which releases the card into a determined distribution box. To this end the carriage goes beyond the chosen distribution box while pushing non return springs, then comes back in such a manner that the non return springs immobilize the card above the chosen distribution box into which this card falls by gravity when the carriage has gone away.

12 Claims, 5 Drawing Sheets

DEVICE FOR READING AND DISTRIBUTING CARDS, IN PARTICULAR PLAYING CARDS

BACKGROUND OF THE INVENTION

1. Field of the Invention

The invention relates to a device for the automatic distribution of cards, in particular playing cards. It relates more particularly to a device of this type which reads the cards as they are distributed, while controlling the method of distribution of the cards in accordance with the codified indications which they comprise.

Devices are known for reading cards such as perforated cards with 80 columns and distributing them in boxes by direction friction transport of the card, but such devices are scarcely applicable to the dealing of playing cards.

Furthermore, optical coding systems are known, called bar codes, but they are particularly unsightly and therefore not adapted to use on playing cards.

2. Description of the Prior Art

From French Pat. No. 2,186,839 an automatic card dealer in which the cards, stacked in a magazine, are removed one by one and are distributed into a plurality of receptacles by means of a deflector flap whose position is controlled by a sequential selection and programming device for distributing the successive cards taken from the magazine in random fashion in two receptacles. With such a distributor the players cannot be given predetermined hands, and it is therefore not usable in particular for tournaments.

From French Pat. No. 2,109,213 a device is known for dealing cards in a predetermined distribution, the cards to be dealt having electric or magnetic contacts and each card being associated successively with a control means which, depending on the position of the contacts on the card, switches this latter to a path of particular orientation. Such a device has the drawback of using electric or magnetic reading of the cards, which complicates the construction thereof. In addition, movement of the cards is provided by means of transporter belts and rollers disposed in different orientations, which is an obstacle to the reliability of the device.

SUMMARY OF THE INVENTION

The present invention seeks to overcome the drawbacks of known devices and it provides for this purpose a card reading and dealing device which optically reads the cards to be dealt without the coding included on these latter having an unsightly character, which deals the cards according to predetermined hands while ensuring transport of the cards and selective distriction thereof simply and efficiently, and which allows reception of the dealt cards in cases such as bridge players, for example receive during tournaments.

According to the invention the apparatus includes a container for receiving the stacked cards to be dealt, a means for removing the cards from the stack, means for reading the information carried by the cards removed from the stack and automatic means for transferring each card removed from the stack into a given housing depending on the information read from the card, and it is characterized by the fact that a horizontal wall of the reception container is formed by a carriage including friction means which cooperate with the corresponding endmost card of the packet of cards to be dealt, this carriage being moved with a translational movement which isolates the endmost card from the other cards of the pack while causing it to pass through a selection device and, after the card has passed in front of the reading device, which transports this latter above said given housing before coming back to its initial position while controlling the fall of the transported card into said given housing.

In a preferred embodiment, the carriage forms the bottom of the container receiving the pack of cards and incorporates with the lower card of this pack by at least one friction roller with transverse axis, disposed in the center of the carriage and designed so as to be able to turn only during the return travel of the carriage, as well as by means of drive tangs disposed in front and/or at the rear of the roller.

Movement of the carriage is controlled by a motor acting on a pulley and cable system connected to the carriage. The amplitude of the travel of the carriage is communicated to the motor by an electronic device from the information read from the transported card. During its transport by the carriage, the card crosses non return devices disposed in line with the vertical transverse walls corresponding to the successive transverse walls of the card reception housings, and the carriage is stopped automatically when the read end of the card is situated between the non return devices corresponding to the front and rear walls of the chosen reception housing, which has the advantage of avoiding the need for precision in stopping the motor. The carriage is then driven in the opposite direction (return travel) and the rear end of the card abuts against the non return device corresponding to the rear wall of the chosen housing, the card being thus immobilized whereas the carriage continues its return movement. When, during its return movement, the carriage crosses the non return device corresponding to the rear wall of the chosen reception housing, the card is released and falls by gravity into this housing.

The device includes a reading device designed to cooperate with coding indications carried by the playing cards to be dealt. The invention also applies to cards, in particular playing cards, having at two opposite corners a reading pattern having four lines and three or four columns depending on the number of cards of different value to be read and dealt. Advantageously, the first line forms a synchronization track always equal to itself, the second and third lines serve for identifying the cards and the fourth line serves for checking the correct reading of the second and third line. In the case of three column coding, the second and third lines allow 64 documents to be identified so at least 52 cards. In the case of four column coding, the possibility of identification is increased to 256 documents, sufficient for example for the 78 cards of a tarot pack.

Such a reading pattern is particularly remarkable in that its form is inscribed symmetrically and aesthetically with respect to the conventional pattern for identifying the playing card.

The device of the invention may also include a second reading device, designed for identifying cards and having information of another kind such for example as information relative to the results of a tournament, to the contents of a hand or to the plan of this hand. The invention also applies to such cards, which may advantageously be in the form of tickets breakable in the middle so as to be given the format of a playing card and having a plurality of tracks intended to receive a code.

BRIEF DESCRIPTION OF THE DRAWINGS

For a better understanding of the device of the invention, a preferred embodiment thereof will be described hereafter, by way of non limitative example, with reference to the accompanying drawings in which.

DESCRIPTION OF THE PREFERRED EMBODIMENT

Figure 1:
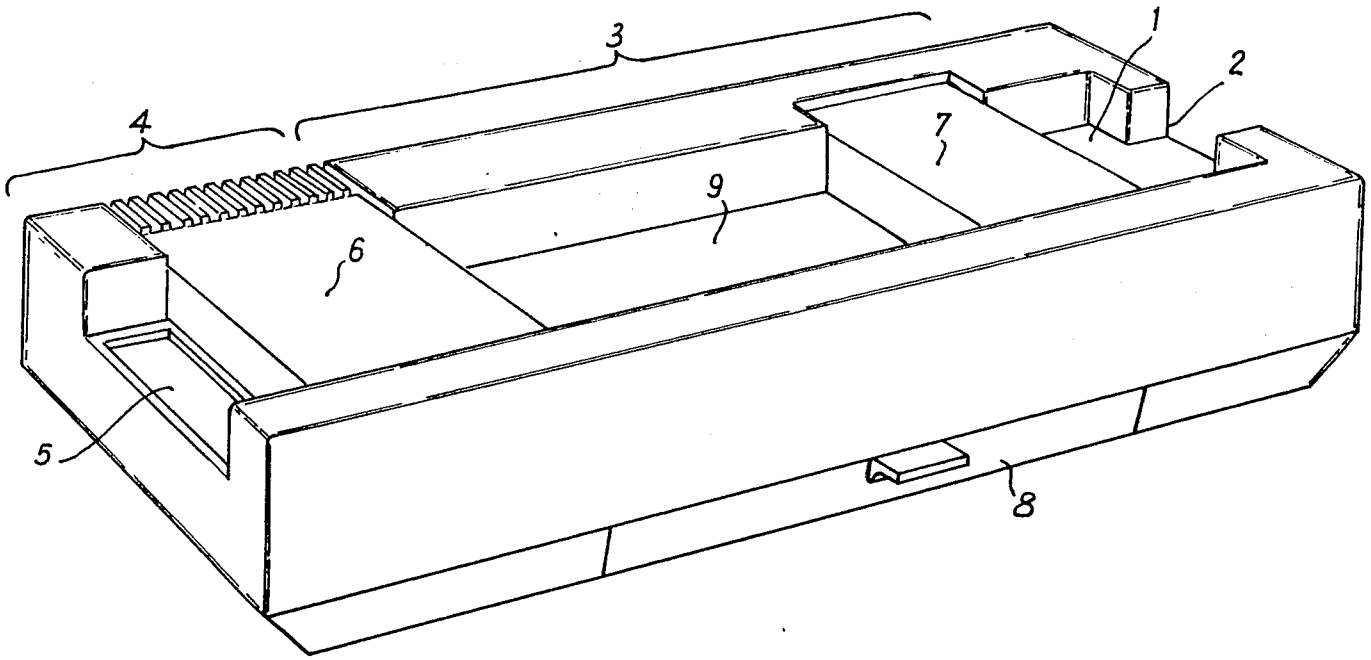
FIG. 1 is a perspective view of a device of the invention for reading and selectively dealing playing cards.

With reference more particularly to FIG. 1, the device of the invention is in the form of an elongate case which has at one end a container 1 to the size of the packet of cards to be received, the introduction of this card being facilitated by a slit 2 which allows the fingers of the user to pass therethrough. Beyond container 1, the device includes a central zone 3 which has card distribution boxes. As will be seen further on, these boxes are four in number in the example shown, but this number may vary depending on the mode of use of the device. At 4 has been shown a zone including electric and electronic equipment of known type ensuring the operation of the device. In zone 4 is formed an orifice 5 which may receive a memory cartridge for increasing the capacity of the apparatus. At 6 may be disposed a keyboard, not shown in the drawings, equipped with a diode or liquid crystal display system, but this option may advantageously be replaced by the screen and keyboard of a microprocessor or a telecommunication terminal, connectable to the device. At 7 has been shown the position of an optical reading block, with about 13 tracks which is situated beyond the first distribution box.

In the lower part of the apparatus, a card drawer 8 includes a certain number of boxes (four in the example shown) which correspond to the distribution boxes of zone 3 of the apparatus. At 9 is located a zone of direct access to the card distribution boxes, for intervening should a malfunction occur.

Figure 2:
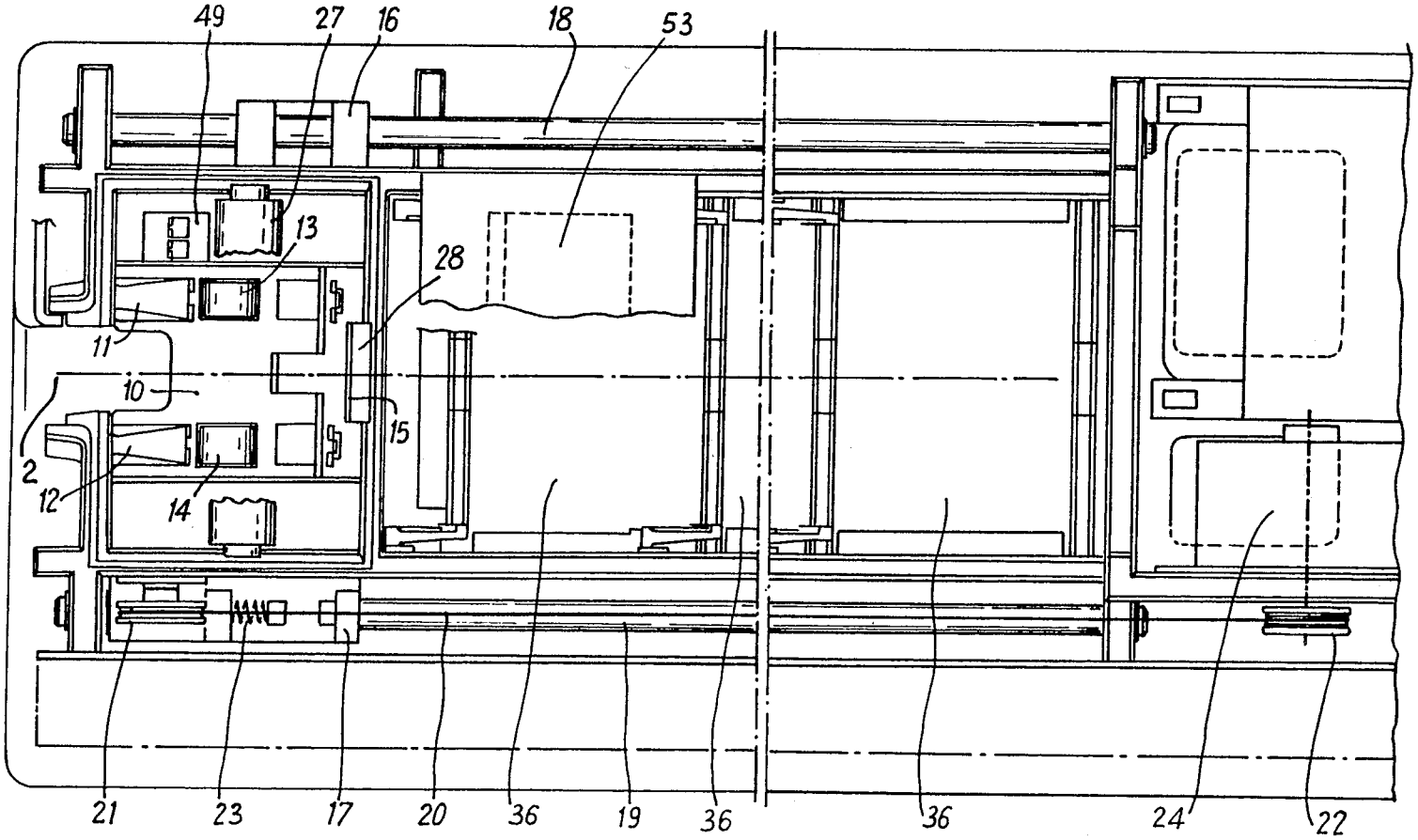
FIG. 2 is a partial top view of the device of FIG. 1, showing more particularly the magazine receiving the cards to be dealt and the carriage for transporting the cards.

As will be seen more particularly in FIG. 2, the bottom of container 1 is formed by a carriage 10 which includes towards the rear two drive tangs 11, 12 in its intermediate part two drive rollers 13, 14 made from flexible rubber and equipped with non return means, and towards the front a tang 15. The carriage is extended laterally by arms 16, 17 providing guidance thereof along longitudinal rods 18, 19. Arm 16 cooperates with rod 18 through an antifriction socket and arm 17 includes a guide fork thus preventing the guide system from being hyperstatic. To arm 17 is fixed a flexible cable 20 which is continuously stretched between two pulleys 21, 22 by a spring 23. Pulley 21 is mounted for free rotation, whereas pulley 22 is driven by a motor 24 (not shown). By means of a control explained further on, motor 24 drives cable 20 by friction and, consequently, the carriage 10 is moved rightwards to a greater or lesser amount in direction of the distribution boxes then comes back from the right towards the left as far as its initial position.

Figure 3:
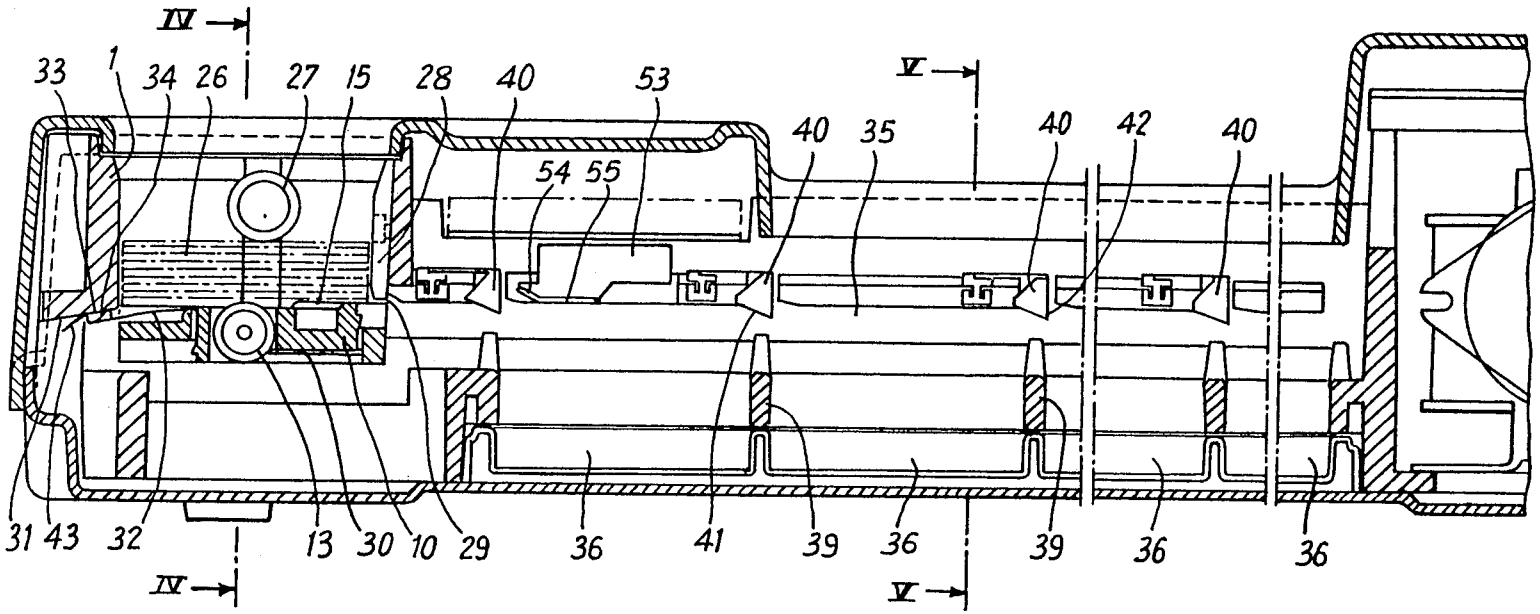
FIG. 3 is a partial vertical and longitudinal sectional view of the device.

As can be seen more particularly in FIG. 3, the pack of cards 26 rests on carriage 10 while bearing on rollers 13, 14 on the one hand and on the tang 15 of this carriage on the other. To ensure good engagement of cards 26 on carriage 10, a weight 27 is placed on the pack of cards between the access of rollers 13, 14 and tang 15. An adjustable flange 28 is carried by the front vertical wall of container 1 and this flange forms with tang 15 a space 29 slightly greater than the thickness of a card, thus allowing carriage 10 to drive only a single card at a time out of container 1 (the lower card of pack 26), the other cards of the pack abutting against the flange 28.

During their movement, the rubber rollers 13, 14 of the carriage 10, under the pressure of weight 27 and by means of their non return device formed by a resilient blade 13, braced on the rubber of the roller during advance of carriage 10 and maintaining a slight friction during the return movement, drive the cards from pack 26 by adherence until the lower card, driven directly by the roller, slides into the calibrated space 29 formed by flange 28, thus selecting a single card. A rear tang 31 of carriage 10, which in the initial position of this carriage is pressed by a resilient blade 32 under a ramp 33 of container 1, slides under the pack of cards 26 when the lower card of this pack is selected through space 29, and the edge 34 of this tang 31 possibly engages with the edge of the selected card thus avoiding any risk of sliding thereof. During the movement, the axis of rollers 13, 14 pass beyond the axis of weight 27, so that the pack of cards 26 pivots in an anti-clockwise direction at the rear of carriage 10, about a generatrix of rollers 13, 14, thus improving the contact of the selected card with the edge 34 of tang 31. The card then bends slightly while being deformed, which maintains the pressure on rollers 13, 14.

Carriage 10 is then engaged in the passageway 35 situated above the card distribution boxes 36, the selected card being nipped between the bearing surfaces 11, 12, 13, 14 of carriage 10 and an overhanging portion 37 of the passageway, transverse guidance thereof being provided by the walls 38 of the passageway 35. This passageway 35 has vertical cross pieces 39 defining longitudinally the card distribution boxes 36 integrated in drawer 8. In line with the cross pieces 38, except for that one of them situated at the extreme right, non return springs 40 are disposed in the upper part of passageway 35 so as to be situated in the path of the card transported by carriage 10. Each spring 40 retracts towards the right when it is engaged, on its ramp 41 side, by the card transported by carriage 10 moving from left to right, then comes resiliently back to its initial position after the card has gone beyond the rear vertical face 42 of the spring.

Control of carriage 10 is such that it is stopped so that the rear edge of the card which it transports is situated indifferently between two non return springs 40, which thus avoids the need for any precision in stopping the motor.

During the return movement of carriage 10, it takes the card with it until the rear edge of this card abuts against the vertical face 42 of a non return spring 40. The card then remains in position while the carriage 10 continues its return movement, rollers 13, 14 whose rotation is permitted in this direction do not hinder the relative movement of the carriage and of the card. As soon as the front edge of carriage 10 reaches the position of the vertical face 42 of the non return spring 40 immobilizing the card, this latter is released and falls by gravity between the cross pieces 39 to the corresponding box 36 of drawer 8.

The carriage 10 without card comes back towards the pack of cards 26. The tang 31 of this carriage is equipped with a ramp 43 which slides during its return travel under flange 28, under the pack of cards 26, then under the ramp 33 of container 1 so as to come back to its initial position. In this direction of movement, rollers 13, 14 are free to rotate under the pack of cards.

Having described the method of removing the successive cards from the pack, transporting them and releasing them by means of the device of the invention, there will now be described how the movement of the carriage is controlled and, in particular, how, as a function of the value of each card dealt, the movement of the carriage is chosen corresponding to the dealing of this card in a chosen reception box 36, so as to form a predetermined hand.

Figure 7:
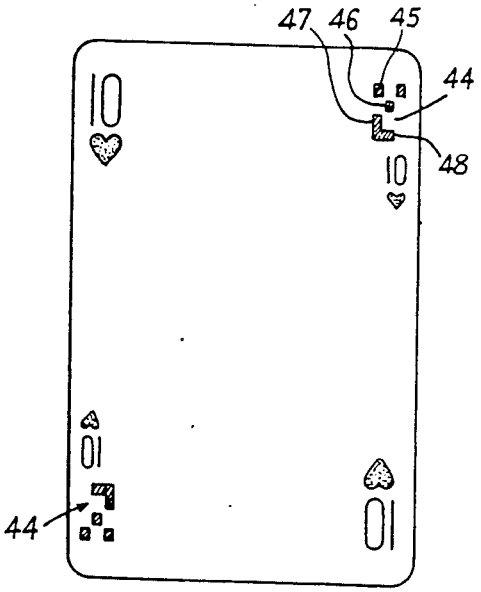
FIG. 7 is a front view of a playing card with its optical reading code system.

As can be seen in FIG. 7, each card 26 to be dealt includes at the top and to the right a reading pattern 44. This includes four lines and three columns, that is to say the possibility of inscribing up to ten colored points (red or black) on a white background which are intended for identification of the card by the device. The first line 45 of this pattern forms a synchronization track, identical for all the cards. The second and third lines, respectively 46 and 47 represent six bits and allow up to 64 documents to be identified so at least the 52 cards of a conventional pack of card. In the case of a tarot pack, having 78 cards, the reading pattern will include an additional column for identifying up to 256 documents. The fourth line 48 serves, by a parity control, for checking the correct reading of lines 46, 47 thus reducing the risks of error.

The reading pattern 48 is remarkable in that its form of three by four points (or four by four points for the tarot pack) is inscribed symmetrically and aesthetically with respect to the usual identification pattern of the card.

The pattern 44 of each card 26 of the pack placed in container 1 is intended to come opposite an optical reader 49 (see FIG. 2) so that the pattern 44 of the lower card of the pack is read during the movement of carriage 10 driving this card. The information is transmitted to the electronic apparatus of the device (disposed in zone 4 and not shown or described because already known per se) which compares it with the list of a hand established by the device, or by a center server or by a hand dealing card, (or else input by means of a keyboard) and assigns the card to one of the distribution boxes 36 by causing, through motor 24 a movement of carriage 10 which corresponds to the dealing of the card into this box.

Figure 8:
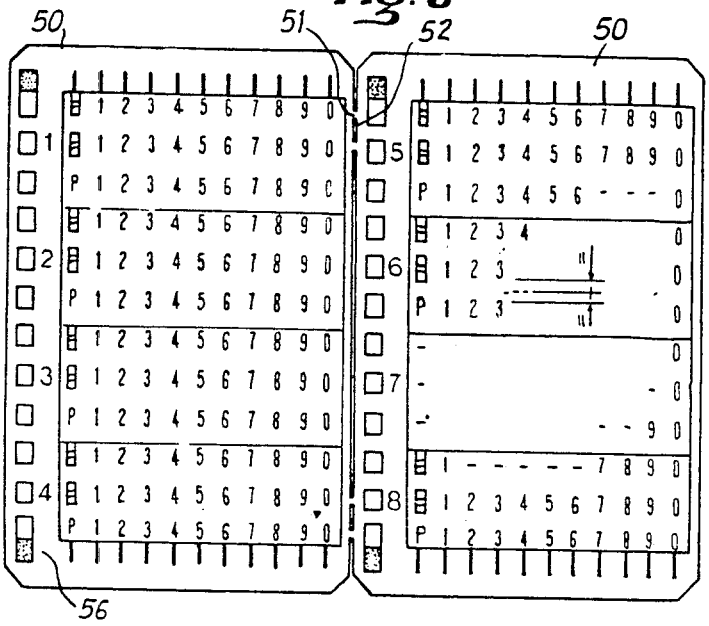
FIG. 8 is a front view of a card giving the result of a hand with a 13 track marking system.

In FIG. 8 a result ticket has been shown at 50, usable in bridge tournaments for example, which is formed of two parts each having the format of a playing card and which are joined together by parts to be broken 51, 52 designed so that the rough edges caused by the breakage do not constitute an inconvenience for the tangs 11, 12, and 31 of carriage 10 when these ticket parts are stacked and introduced into container 1 of the device. These tickets 50, printed in red, include figures which may be crossed out with a black or blue pencil so as to be read by an optical reader 53 disposed in position 7 in FIG. 1, above the first distribution box 36. This optical reader may include a shoe 54 promoting input of the cards, and a glass 55 preventing the entry of dust.

In the version shown, ticket 50 has fourteen tracks (line), namely twelve result tracks and two synchronization tracks. An offset of the thirteen track reader 53 allows the direction of introduction of the card to be recognized which may be introduced indifferently in both directions. A code in the margin 56 of ticket 50 provides identification of the game and of the player. The ticket may be printed on both sides and pass through the device twice for reading both faces.

It will be readily understood that the tickets 50, including the results of a tournament, are disposed in the receiving container 1 and are brought by carriage 10 in front of the reader 53 whose information, compared with a typical result entered in the device, controls the distribution in a predetermined box 36 of the tickets 50 conforming to this typical result. However, in the same way, ticket 50 could include instructions for the machine such as the data of a deal or the plan of the deal.

The operation of the device of the invention will be readily understood from the preceding description and it will only be discussed briefly on the assumption of a bridge deal to be made in accordance with data input into the device. The lower card 26 of the pack to be distributed introduced into container 1 of the device is driven towards the left of FIG. 2 by adherence by carriage 10 while passing through the space 29 formed under the flange 28 and having one of the patterns 44 which passes in front of the reader 49. The carriage 10 and the card which it carries move along the passageway 35, above the distribution boxes 36, while pushing the non return springs 4 back towards the right. By comparing the information concerning the value of the card transmitted by reader 16 with the data of the deal to be made, the electronic system of the device, through motor 24, stops the carriage 10 in a position where it is situated in front of the non return spring 40 corresponding to the rear front wall of box 36 in which the card is to be dealt. The carriage 10 then comes back to its initial position so as to cooperate with the card which is then at the bottom of the pack to be dealt, whereas the transported card is immobilized by the non return spring above the chosen box 36 and falls by gravity into this box as soon as carriage 10 has gone beyond this non return device.

Figure 6:
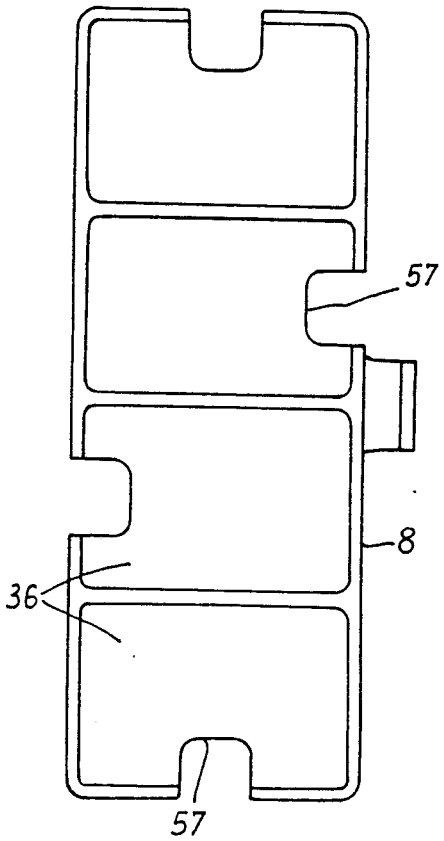
FIG. 6 is a top view of the card drawer.

As shown in FIG. 6, the drawer 8, intended to receive a bridge deal, includes four boxes 36 having notches 37 facilitating picking up of the cards. Advantageously, a lid that can be folded back, not shown, may be associated with the drawer 8 for holding the cards in position during transport, thus forming a card case. In the case of a deal for the game of "belot", drawer 8 would then have five distribution boxes 36.

Figure 5:
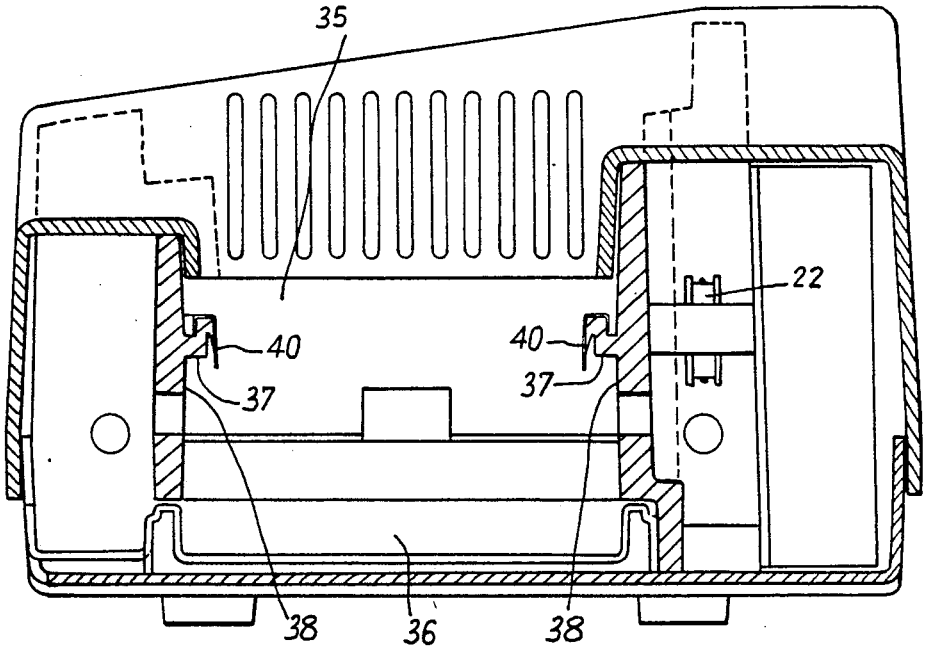
FIG. 5 is a cross sectional view taken through line V—V of FIG. 3.
Figure 4:
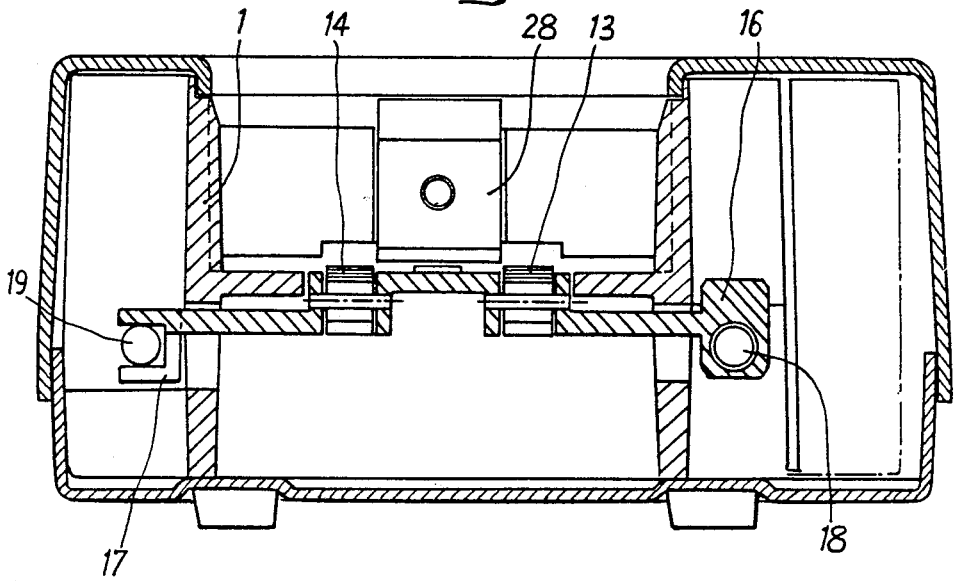
FIG. 4 is a cross sectional view through line IV—VI of FIG. 3.

It would be noted, in reference to FIG. 5, that the overhanding portions 37 of passageway 35, guiding the card, cooperate therewith at a level slightly lower than that of the carraige so that the card is in a curved position favorable to transport thereof. Ramp 54 is intended to flatten the card before it passes in front of the reader 53.

It will be understood that the above description has been given solely by way of example and that constructional additions or modifications could be made thereto without departing from the scope and spirit of the invention defined by the following claims.

What is claimed is:

1. A device for reading and dealing cards, in particular playing cards which comprises:

(a) a container adapted to receive a pack of stacked cards, (b) a movable bottom for said container, said bottom comprising a carriage adapted to perform a translation movement along a path according to an outgoing travel and a return travel under the action of motor means, (c) friction means carried by said carriage and adapted to engage a face of the lower card of said pack, (d) receiving boxes for cards to be dealt which are aligned at a lower level parallel to the path along which the carriage is caused to move, (e) means for reading information carried by the lower card, (f) selection means for separating said lower card from the other cards of the pack at the beginning of the outgoing travel of the carriage, (g) means for guiding the face of the lower card opposite to the face engaged by said friction means during the outgoing travel of the carriage so that said lower card moves together with said carriage, (h) means comparing said information read on the lower card with basic information relating to the deal to be distributed and controlling a stop of the outoing travel of the carriage above a chosen receiving box, and (i) means preventing said lower card from moving together with said carriage when said carriage performs its return travel, said lower card then falling by gravity into said chosen receiving box.

2. The device as claimed in claim 1 wherein said friction means equipping the carriage includes at least one roller with transverse axis disposed in the central part of the carriage and drive tongs disposed in front and at the rear of said roller.

3. The device as claimed in claim 2 wherein the roller equipping the carriage is provided with a non-return device.

4. The device as claimed in claim 3 wherein said nonreturn device consists of a resilient blade cooperating with the periphery of the roller, which prevents rotation of the roller during the outgoing travel of the carriage transporting the card and allows rotation in the reverse direction of the roller during the return travel of the carriage.

5. The device as claimed in claim 1 wherein the selection means for isolating the lower card from the pack of cards is formed by an adjustable flange carried by a front wall of the container and forming with the carriage a space slightly greater than the thickness of the lower card.

6. The device as claimed in claim 1 wherein the movement of the carriage is controlled by a motor driving a drive pulley over which travels a cable connected to the carriage, actuation of the motor which determines the travel of the carriage being ensured by an electronic control circuit responsive to the information read from the transported lower card.

7. The device as claimed in claim 1 comprising nonreturn devices in the form of oscillating springs with a front vertical face and a rear face in the form of a ramp, said oscillating springs being disposed in the path of the transported lower card in line with transverse guide walls corresponding to the card receiving boxes, so as to allow passage of the lower card carried by the carriage during the outoing travel of the carriage and to immobilize the card above the chosen receiving box during the return travel of the carriage.

8. The device as claimed in claim 6 wherein stopping of the outgoing travel of the carriage is caused when said carriage is astride between the receiving box chosen for the card and the adjacent housing disposed towards the front of the device.

9. The device as claimed in claim 1 wherein the card receiving boxes are integrated in a removable drawer accessible at the lower part of the device.

10. The device as claimed in claim 1, wherein said means for reading information includes an optical reader adapted for reading information concerning the value of cards to be played which are introduced into the container.

11. The device as claimed in claim 1 wherein said means for reading information includes an optical reader designed for reading information carried by tickets, such as result cards, dealing instructions of dealing plans, having the format of playing cards.

12. The device as claimed in claim 7 wherein the path in the form of a passageway along which the card carried by the carriage moves has laterally overhanging portions cooperating with the upper face of the transported lower card, these overhanging portions coming at a level slightly less than that of the carriage so as to give to the transported card a slightly curved position.

* * * * *